US006554240B1

(12) United States Patent
Peterson

(10) Patent No.: US 6,554,240 B1
(45) Date of Patent: Apr. 29, 2003

(54) PROTECTIVE DEVICE FOR FRAGILE PLATES AND GLASSES

(76) Inventor: Eric Peterson, 10101 N. Donegal Rd., Midlothian, VA (US) 23112

( * ) Notice: Subject to any disclaimer, the term of this patent is extended or adjusted under 35 U.S.C. 154(b) by 0 days.

(21) Appl. No.: 09/976,138

(22) Filed: Oct. 15, 2001

(51) Int. Cl.[7] ..... A47F 5/00
(52) U.S. Cl. ..... 248/309.1
(58) Field of Search ..... 248/309.1, 682, 248/687, 311.2, 345.1, 346.11; 206/521, 585, 592, 593, 454, 426, 445, 821, 499

(56) References Cited

U.S. PATENT DOCUMENTS 3,484,016 A * 12/1969 Turner ..... 220/60
4,113,096 A 9/1978 Scott ..... 206/523
4,473,207 A * 9/1984 Nascher ..... 248/490
4,687,169 A * 8/1987 Thomas ..... 248/490
4,739,961 A * 4/1988 Thomas ..... 248/490
5,152,493 A * 10/1992 Giles ..... 248/490
5,285,996 A 2/1994 Waller ..... 248/687
5,454,539 A * 10/1995 Lafontaine ..... 248/302
5,634,617 A 6/1997 Morris ..... 248/152
5,842,675 A 12/1998 Davitt ..... 248/346.5
6,007,041 A * 12/1999 Law ..... 248/491
6,290,084 B1 * 9/2001 Louie ..... 220/256

* cited by examiner

*Primary Examiner*—Ramon O. Ramirez
*Assistant Examiner*—Kofi Schulterbrandt
(74) *Attorney, Agent, or Firm*—Sturm & Fix LLP

(57) ABSTRACT

A protective cover device (10) (10)' whose basic components are equally suitable for protecting fragile china plates (100) and glasses (200) merely by changing the dimensions of the basic components which include a generally cruciform shaped strap arrangement (25) (25)' whose outer ends are formed integrally with an outer ring element (22) (22') having a backwardly directed lip (23) (23') forming a peripheral recess (24) (24') that engages the outer edge (101) of a plate (100) or the upper rim (201) of a glass (200) to protect those fragile surfaces.

7 Claims, 2 Drawing Sheets

PROTECTIVE DEVICE FOR FRAGILE PLATES AND GLASSES

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of protective devices in general and in particular to a protective device specifically designed for fine china and crystal glassware.

2. Description of Related Art

As can be seen by reference to the following U.S. Pat. Nos. 5,842,675; 4,113,096; 5,634,617; and, 5,285,996, the prior art is replete with myriad and diverse protective cover devices for a variety of different items.

While all of the aforementioned prior art constructions are more than adequate for the basic purpose and function for which they have been specifically designed, they are uniformly deficient with respect to their failure to provide a simple, efficient, and practical protective cover device for fine china and glassware.

As anyone who has invested in fine china and glassware is all too well aware, the greatest threat to their investment involves the chipping and/or scratching of the fragile surfaces while being handled during placement into or being removed from storage when the edges of the moved fragile articles tend to come into contact with portions of stationary fragile articles.

As a consequence of the foregoing situation, there has existed a longstanding need among owners of fine china and glassware for a new and improved protective device that covers the bottom, edges, and sides of these fragile articles so that they can be stacked or nested relative to one another without fear of chipping or scratching of the delicate surfaces; and, the provision of such a construction is a stated objective of the present invention.

BRIEF SUMMARY OF THE INVENTION

Briefly stated, the protective cover device that forms the basis of the present invention comprises in general a one piece cover member fabricated from generally resilient and flexible material possessing a degree of plastic memory that will allow the material to return to its original configuration after being stretched to cover a particular fragile article.

As will be explained in greater detail further on in the specification, the cover member comes in a plate version and a glass version wherein both versions include: a protective outer ring element having an inwardly curved lip adapted to cover and protect the outer or upper edge of a plate or glass; and, a generally cruciform strap arrangement that protects the undersides and outer sides respectively as well as portions of the bottom surface of the plate and glasses.

In addition, in the plate version of this invention, the cover member also includes an inner protective ring element that rests beneath the bottom rim of a plate so that the bottom rim of one plate cannot come into contact with the top surface of an underlying plate.

BRIEF DESCRIPTION OF THE SEVERAL VIEWS-OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
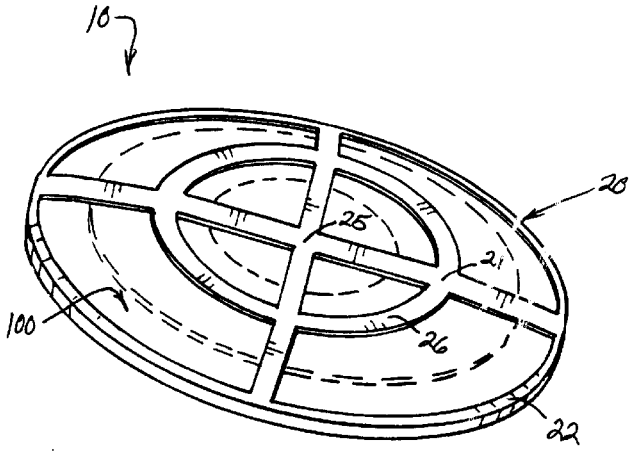
FIG. 1 is a perspective view of the plate version of the protective cover disposed on the bottom of a plate.

As can be seen by reference to the drawings, and in particularly to FIG. 1, the protective cover device that forms the basis of the present invention is designated generally by the reference number 10. The cover device 10 comprises a generally resilient cover member 20 fabricated from a generally transparent elastic material 21 such as clear rubber, soft flexible plastic, or the like formed into an open framework configuration.

In the plate version of the preferred embodiment depicted in FIGS. 1 through 5, the cover member 20 includes an outer ring element 22 provided with a rearwardly curved lip which defines a peripheral slot 24 that is dimensioned to releasably engage the outer peripheral rim 101 of a plate 100.

Figure 2:
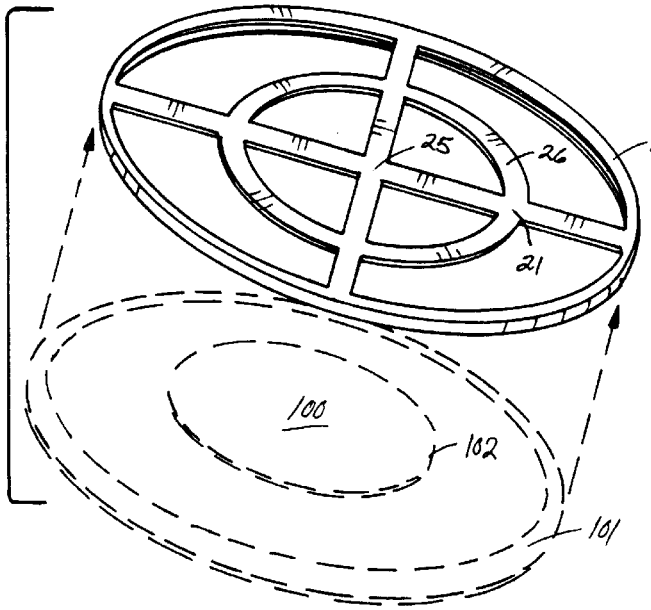
FIG. 2 is an exploded perspective view of the arrangement depicted in FIG. 2.
Figure 3:
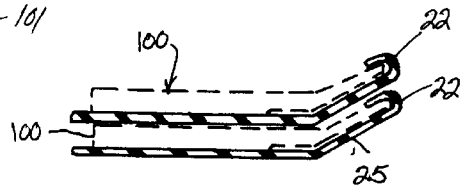
FIG. 3 is an isolated cross-sectional detail view of the outer edge of a pair of plates equipped with the protective cover.
Figure 4:
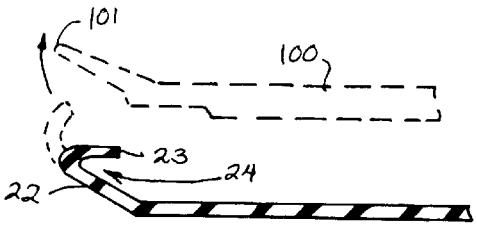
FIG. 4 is an exploded perspective view of the outer edge of a single plate and the outer portion of the protective cover.
Figure 5:
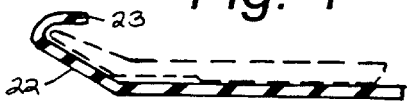
FIG. 5 is an isolated detail view of the assembled relationship between the outer edge of a plate and the outer portion of the protective cover.

In addition, as can best be appreciated by reference to FIGS. 1 and 2, the cover member 20 further includes a generally cruciform strap arrangement 25 wherein the outer ends of the cruciform strap arrangement 25 are formed integrally with the outer ring element 22; and, wherein an inner ring element 26 is formed integrally with and intersects the mid-portion of the arms of the cruciform strap arrangement 25.

Furthermore, as shown in FIG. 2, the inner ring element 26 is dimensioned to overlie the bottom rim 102 of the plate 100 so that the bottom rim 102 rests upon the inner ring; element 26 when the plate 100 is disposed in its normal upright position.

Figure 6:
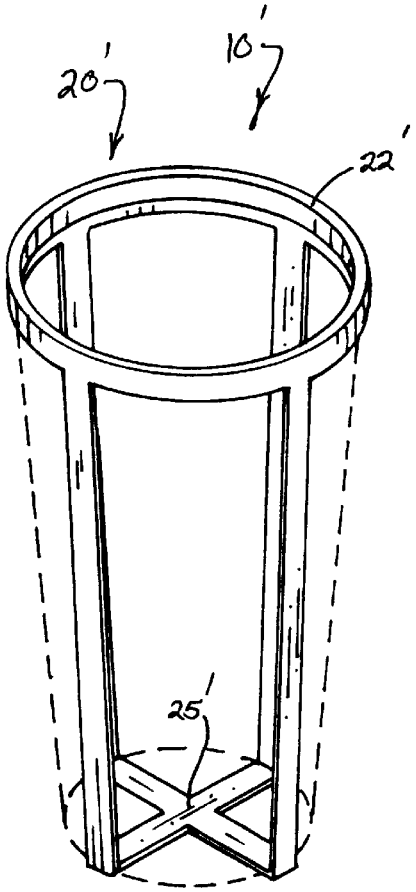
FIG. 6 is a perspective view of the glass version of the protective cover installed on a drinking glass.
Figure 7:
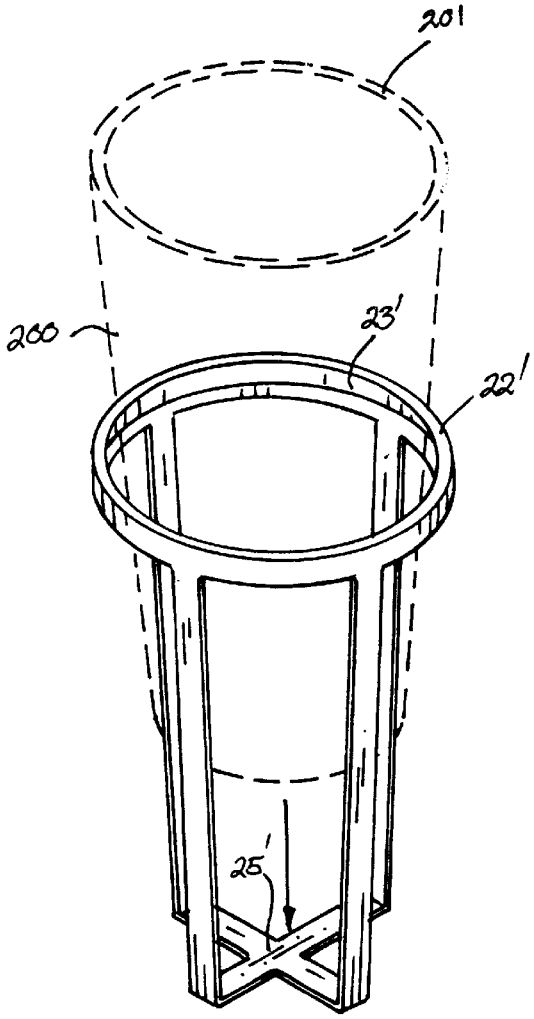
FIG. 7 is an exploded perspective view of the arrangement depicted in FIG. 6; and, FIG. 8 is an isolated cross-sectional view of the protective cover engaged with the top of a drinking glass.
Figure 8:
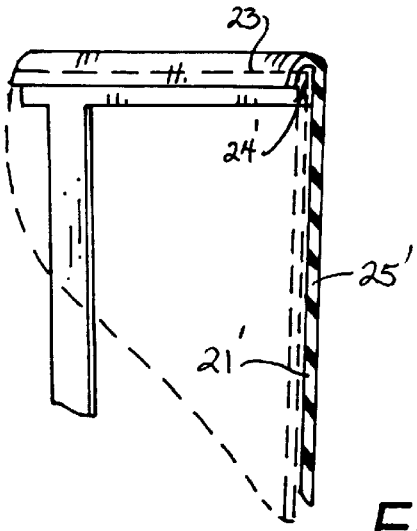

Turning now to FIGS. 6 through 8, it can be seen that in the glass version of the cover device 10', the cover member 20' is likewise fabricated from a generally transparent material 20' having a rearwardly or downwardly directed lip 23' defining a slot 24' that is dimensioned to receive the top rim 201 of a glass 200.

In addition, as was the case with the plate version of the preferred embodiment, the outer ring element 22' is formed integrally with a generally cruciform strap arrangement 25' which is dimensioned to extend along the sides and bottom of a drinking glass 200 so that the glasses can be stacked in a nested fashion without the sides of the glasses coming into contact with one another.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A protective cover device for protecting the fragile contact points of fine china and glassware wherein the cover device comprises a generally resilient cover member having an open framework configuration including an outer ring element having a backwardly extending lip that defines a peripheral recess; and, a generally cruciform shaped strap arrangement wherein the outer ends of the strap arrangement are connected to and formed integrally with the outer ring element.

2. The cover device as in claim 1; wherein, the outer ring element is formed from a resilient deformable material.

3. The cover device as in claim 1; wherein, the outer ring element is formed from a generally clear elastic material.

4. The cover device as in claim 1; further comprising an inner ring element disposed intermediate the outer ring element and the center of the cruciform strap arrangement.

5. The cover device as in claim 4; wherein, the inner ring element is formed integrally with the strap arrangement.

6. The cover device as in claim 5; wherein, the outer ring element is formed from a resilient deformable material.

7. The cover device as in claim 5; wherein, the outer ring element is formed from a generally clear elastic material.

* * * * *